US008092272B2

(12) United States Patent
Yang

(10) Patent No.: US 8,092,272 B2
(45) Date of Patent: Jan. 10, 2012

(54) MOVEABLE ELECTRONIC TOY

(75) Inventor: Wen-Yan Yang, Shenzhen (CN)

(73) Assignee: Hong Fu Jin Precision Industry (ShenZhen) Co., Ltd., Shenzhen, Guangdong Province (CN)

( * ) Notice: Subject to any disclaimer, the term of this patent is extended or adjusted under 35 U.S.C. 154(b) by 164 days.

(21) Appl. No.: 12/541,132

(22) Filed: Aug. 13, 2009

(65) Prior Publication Data

US 2010/0062681 A1 Mar. 11, 2010

(30) Foreign Application Priority Data

Sep. 5, 2008 (CN) ..... 2008 1 0304377

(51) Int. Cl.
*A63H 17/25* (2006.01)
*A63H 17/36* (2006.01)

(52) U.S. Cl. ..... 446/465; 446/468; 446/460

(58) Field of Classification Search ..... 446/431, 446/437, 441–444, 457, 465–471, 484; 280/47.38, 280/827, 1.13
See application file for complete search history.

(56) References Cited

U.S. PATENT DOCUMENTS

| | | | | |
|---|---|---|---|---|
| 3,791,662 | A * | 2/1974 | Glass et al. | 280/827 |
| 4,023,816 | A * | 5/1977 | Ellman et al. | 280/1.13 |
| 4,516,648 | A * | 5/1985 | Berger et al. | 180/6.66 |
| 5,549,501 | A * | 8/1996 | Jow | 446/460 |
| 6,250,652 | B1 * | 6/2001 | Nelson | 280/47.38 |

* cited by examiner

*Primary Examiner* — Kien Nguyen
(74) *Attorney, Agent, or Firm* — Altis Law Group, Inc.

(57) ABSTRACT

A moveable electronic toy includes a base, a base cover, two wheels and two wheel covers. The base cover is fixedly mounted on the base. The two wheels are rotatably connected to the base and exposed from the base cover. The two wheel covers is detachably coupled to the base cover and is configured for covering the wheels.

11 Claims, 4 Drawing Sheets

MOVEABLE ELECTRONIC TOY

BACKGROUND

1. Technical Field

The present disclosure relates to toys, and particularly, to a moveable electronic toy.

2. Description of Related Art

An electronic toy with wheels may be entangled by thread-like things, such as threads, yarns etc., in the wheels. The electronic toy has to be taken apart to get rid of these thread-like things. However, some conventional electronic toy includes wheel covers. Therefore, the wheel covers must be detached from a body of the toy to get rid of these threadlike things.

Therefore, there is a need exist for a moveable electronic toy, in which the above problem is eliminated or at least alleviated.

DETAILED DESCRIPTION

Figure 1:
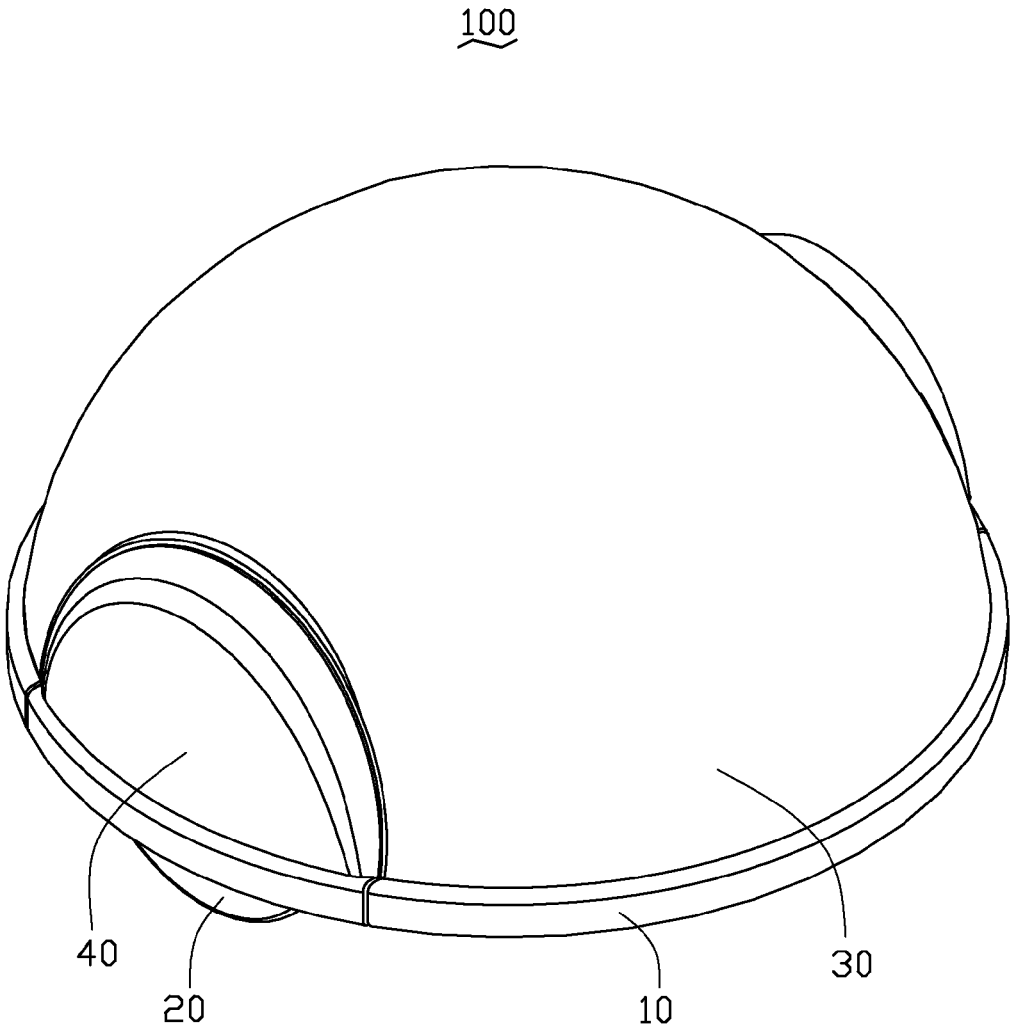
FIG. 1 is an isometric and schematic view of a moveable electronic toy, according to an exemplary embodiment.
Figure 2:
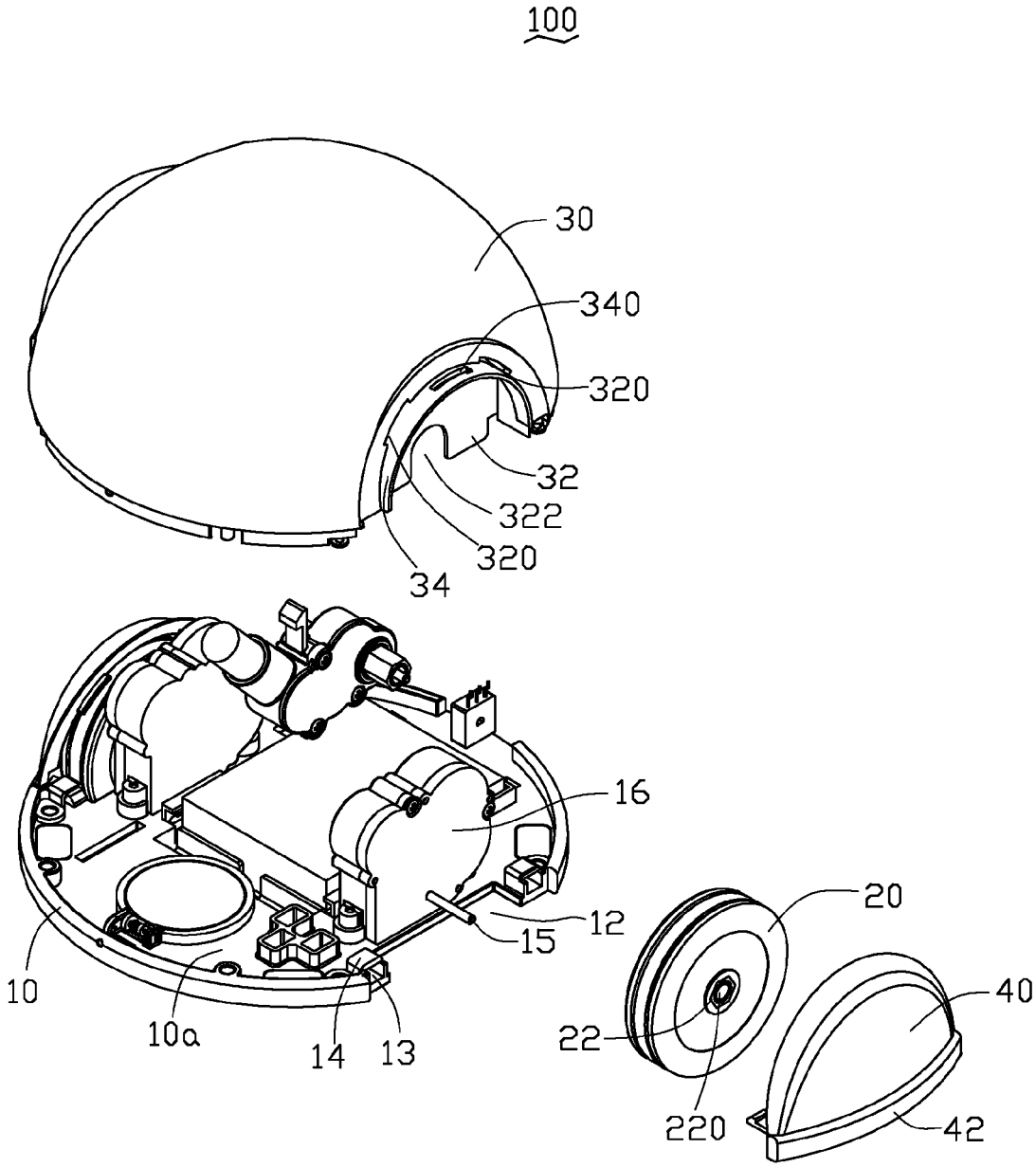
FIG. 2 is a partially disassembled view of the moveable electronic toy of FIG. 1.

Referring to FIGS. 1 and 2, a moveable electronic toy 100, according to an exemplary embodiment, includes a base 10, two wheels 20 rotatably connected to two opposite sides of the base 10, a base cover 30, and two wheel covers 40. The base cover 30 is mounted on the base 10. Each wheel cover 40 is detachably coupled to the base 10 and the base cover 30. Each wheel cover 40 covers a corresponding wheel 20.

The base 10 is substantially disc-shaped. Two cutouts 12 (only a cutout 12 labeled in FIG. 2) for receiving the two wheels 20 are defined at the periphery of the base 10 along a radial direction of the base 10. Two motor plates 16 are positioned perpendicularly on an inner surface 10*a* of the base 10. A rotor 15 extends through the motor plate 16. Two fixing portions 14 are formed on the inner surface 10*a* of the base 10 with locations at two opposite sides of the cutout 12. The fixing portion 14 is substantially rectangular. An engaging hole 13 is defined in the fixing portion 14 with a direction parallel to an axial direction of the rotor 15.

The base cover 30 is fixedly mounted on the base 10 and is substantially dome-shaped. The base cover 30 includes two side plates 32 corresponding to the two cutouts 12. The side plate 32 is substantially perpendicular to the axis of the rotor 15. Each of the side plates 32 is between the motor plate 16 and the wheel 20. An opening 322 is defined in the side plate 32 corresponding to the rotor 15. The rotor 15 extends through the opening 322. The side plate 32 can impede small particles, such as sand, from entering the interior of the electronic toy 100.

An arched outer flange 34 extends perpendicularly from the side plate 32. The outer flange 34 is elastic. An engaging slot 340 is defined in a top portion of the outer flange 34. Two guiding slots 320 are defined in the side plate 32. The two guiding slots 320 are at a side of the outer flange 34 away from the base 10.

The two wheels 20 are received in the two cutouts 12 respectively. A bearing 22 is positioned in the center of the wheel 20. The bearing 22 is substantially a uniform-hexagonal-prism shape. An axle hole 220 is defined in the bearing 22. The rotor 15 is non-rotatably received in the axle hole 220 so that the wheel 20 can rotate with the rotation of the rotor 15.

Figure 3:
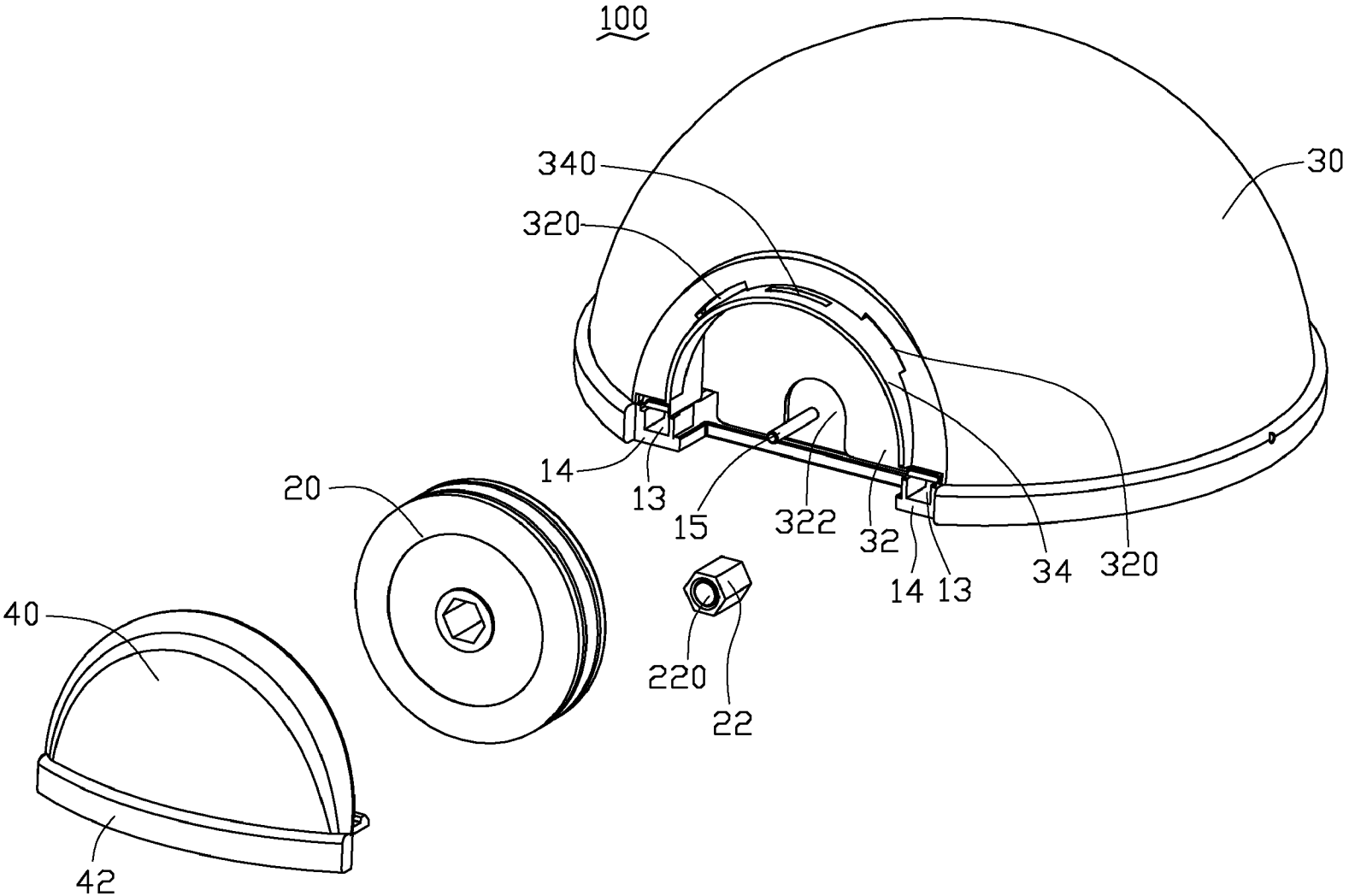
FIG. 3 is another partially dissembled view of the moveable electronic toy of FIG. 1.
Figure 4:
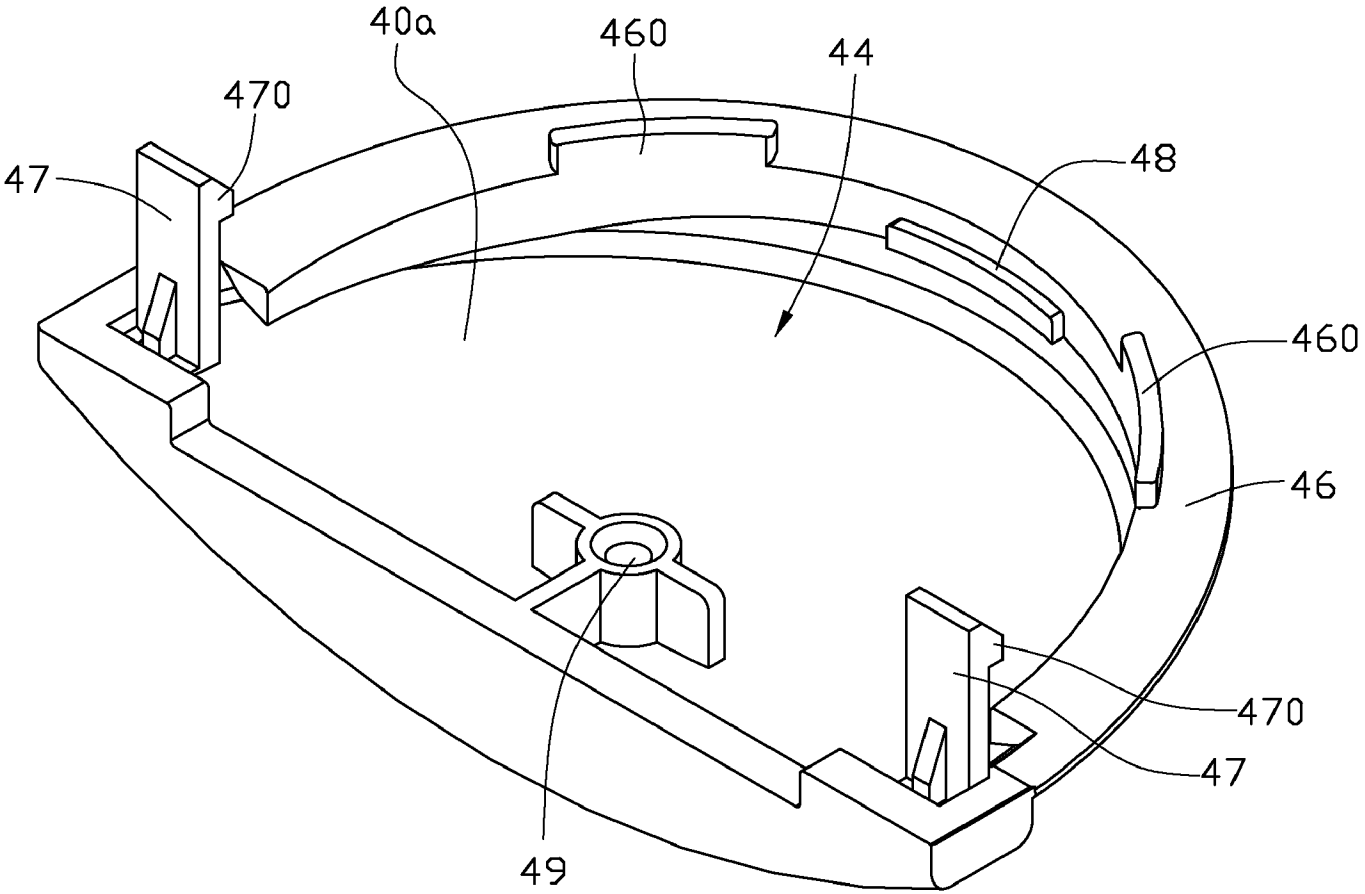
FIG. 4 is an isometric and schematic view of a wheel cover of the moveable electronic toy of FIG. 1.

Further referring to FIGS. 3 and 4, the two wheel covers 40 are detachably coupled to the base 10 and the base cover 30 to cover the two wheels 20. An operation flange 42 is formed at a bottom end of the wheel cover 40 away from the base cover 30.

A receiving cavity 44 is defined in an inner surface 40*a* of the wheel cover 40 for receiving the wheel 20. A half-ring-shaped inner flange 46 extends from the inner surface 40*a* of the wheel cover 40 toward the base cover 30. The receiving cavity 44 is bounded by the inner flange 46. Two guiding protrusions 460 are formed at a distal end of the inner flange 46 corresponding to the two guiding slots 320. The guiding protrusion 460 is received in the guiding slot 320 when the wheel cover 40 is coupled to the base cover 30. Two engaging portions 47 corresponding to the two engaging holes 13 are formed in the inner surface 40*a* of the wheel cover 40. The engaging portion 47 includes an engaging protrusion 470 formed thereon. The engaging portion 47 is made from an elastic material.

An engaging bar 48 is formed on the inner flange 46 with a location in the receiving cavity 44. The engaging bar 48 is elastic and is engaged in the engaging slot 340 to position the wheel cover 40 on the base cover 30. The cover wheel 40 defines a hole 49 in the receiving cavity 44 for receiving a distal end of the rotor 15.

When assembling the wheel cover 40 to the base 10 and the base cover 30, the two guiding protrusions 460 are aligned with the two guiding slots 320 and the two engaging portions 47 are aligned with the two engaging hole 13. The wheel cover 40 is moved toward the base cover 30. The engaging bar 48 abuts the outer flange 34 with the movement of the wheel cover 40 to deform the outer flange 460 and the engaging bar 48. The engaging protrusion 470 is moved into the engaging hole 13 and is deformed by the fixing portion 14. As further movement of the wheel cover 40 toward the base cover 30, the guiding protrusion 460 is received in the guiding slot 320. The engaging bar 48 is engaged in the engaging hole 340 by restoration of the outer flange 34 and the engaging bar 48. The engaging protrusion 470 is engaged with the fixing portion 14 by restoration of the engaging protrusion 470.

When detaching the wheel cover 40 from the base 10 and the base cover, the operation flange 42 is pulled outwards from the bottom of the wheel cover 40 to make the engaging bar 48 and the engaging protrusion 470 deformed. As a result, the engaging bar 48 is detached from the engaging hole 340 and the engaging protrusion 470 is detached from the fixing portion 14. Therefore, the wheel cover 40 can be detached from the base 10 and the base cover 30.

If some threadlike things entangled in the rotor 15 are needed to be gotten rid of, the moveable electronic toy 100 can achieve detaching the wheel cover 40 individually from the base cover 30 and the base 10.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A moveable electronic toy, comprising:

a base;

a base cover fixedly mounted on the base;

two wheels rotatably connected to the base and exposed from the base cover, wherein two cutouts for receiving the two wheels are defined in the base;

two wheel covers detachably coupled to the base cover and configured for covering the wheels, preventing the wheels from being exposed from the base cover; and two motor plates positioned perpendicularly on an inner surface of the base and a rotor extending through each of the motor plates, each of the motor plates adjacent to each of the cutouts, the wheel non-rotatably coupled to the rotor.

2. The moveable electronic toy of claim 1, wherein the base comprises two fixing portions formed on the inner surface of the base, and an engaging hole is defined in each of the fixing portions; the wheel cover comprises two elastic engaging portions corresponding to the two fixing portions, the engaging portion is received in the engaging hole and is engaged with the fixing portion.

3. The moveable electronic toy of claim 2, wherein the engaging hole is defined with a direction parallel to an axial direction of the rotor.

4. The moveable electronic toy of claim 2, wherein the two fixing portions are positioned at locations at two opposite sides of the cutout.

5. The moveable electronic toy of claim 1, wherein the base cover comprises two side plates corresponding to the two cutouts, each of the side plates between the motor plate and the wheel, an opening defined in the side plate corresponding to the rotor, the rotor extending through the opening.

6. The moveable electronic toy of claim 5, wherein an elastic arched outer flange extends perpendicularly from the side plate, an engaging slot defined in a top portion of the outer flange, two guiding slots defined in the side plate with a direction parallel to the axial direction of the rotor, the two guiding slots at a side of the outer flange are away from the base.

7. The moveable electronic toy of claim 1, wherein each of the wheels comprises a bearing is positioned in the center of each of the wheels and an axle hole is defined in the bearing, the rotor is non-rotatably received in the axle hole.

8. The moveable electronic toy of claim 1, wherein an operation flange is formed at a bottom end of the wheel cover away from the base cover.

9. The moveable electronic toy of claim 6, wherein a receiving cavity is defined in an inner surface of the wheel cover for receiving the wheel.

10. The moveable electronic toy of claim 9, wherein a half-ring-shaped inner flange extends from the inner surface of the wheel cover toward the base cover, the receiving cavity bounded by the inner flange, two guiding protrusions formed at a distal end of the inner flange corresponding to the two guiding slots.

11. The moveable electronic toy of claim 10, wherein an elastic engaging bar is formed on the inner flange with a location in the receiving cavity, the engaging bar engaged in the engaging slot to position the wheel cover on the base cover.

* * * * *

UNITED STATES PATENT AND TRADEMARK OFFICE

CERTIFICATE OF CORRECTION

PATENT NO. : 8,092,272 B2
APPLICATION NO. : 12/541132
DATED : January 10, 2012
INVENTOR(S) : Wen-Yan Yang It is certified that error appears in the above-identified patent and that said Letters Patent is hereby corrected as shown below:

Title page, item (73) should read as follows:

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW).

Signed and Sealed this
Twenty-ninth Day of May, 2012

David J. Kappos

David J. Kappos
*Director of the United States Patent and Trademark Office*